US005373916A

United States Patent [19]

Kiviniemi et al.

[11] Patent Number: 5,373,916

[45] Date of Patent: Dec. 20, 1994

[54] CLOSURE MEMBER FOR AN ELEVATOR SHAFT

[75] Inventors: Seppo J. Kiviniemi, Brussels, Belgium; Ari Ketonen, Hyvinkää, Finland

[73] Assignee: Kone Elevator GmbH, Baar, Switzerland

[21] Appl. No.: 116,963

[22] Filed: Sep. 7, 1993

[30] Foreign Application Priority Data

Sep. 8, 1992 [FI] Finland ..... FI 924024

[51] Int. Cl.[5] ..... B66B 13/24

[52] U.S. Cl. ..... 187/336; 160/84.1 E; 187/900

[58] Field of Search ..... 187/62, DIG. 1, 1 R, 187/2; 160/84.1 E, 84.1 C, 40; 211/105.3

[56] References Cited

U.S. PATENT DOCUMENTS

| | | | |
|---|---|---|---|
| 584,380 | 6/1897 | Loveless | 211/105.3 |
| 821,201 | 5/1906 | Taylor | 160/40 |
| 1,299,556 | 4/1919 | Crecelius | 211/105.3 |
| 1,321,219 | 11/1919 | Laureyns | 187/62 |
| 1,643,207 | 9/1927 | Ernst | 187/62 |
| 1,959,137 | 5/1934 | Miller | 106/84.1 E |
| 2,780,373 | 2/1957 | Westmark | 187/2 X |
| 2,911,037 | 11/1959 | Wilson . | |
| 3,425,165 | 2/1969 | Cleveland . | |
| 4,775,056 | 10/1988 | Inglis | 211/105.3 |
| 4,824,302 | 4/1989 | Schultheis et al. | 211/105.3 X |
| 5,104,269 | 4/1992 | Hardison | 211/105.3 X |

FOREIGN PATENT DOCUMENTS

| | | | |
|---|---|---|---|
| 249967 | 3/1964 | Australia | 160/84.1 E X |
| 244563 | 5/1965 | Austria | 160/84.1 E X |
| 1124713 | 10/1956 | France | 160/84.1 E X |
| 1163567 | 9/1958 | France | 160/84.1 E X |
| 2192657 | 1/1988 | United Kingdom . | |

*Primary Examiner*—Robert P. Olszewski
*Assistant Examiner*—Dean A. Reichard

[57] ABSTRACT

The invention relates to a safety apparatus mounted in the doorway of an elevator shaft to prevent people, animals and objects from falling down into the shaft. The safety apparatus comprises a collapsible safety wall composed of laminae (1) and supported by telescopic bars (2). The bars (2) are inserted through holes provided in the laminae and attached by their ends to separate supporting structures (3) either with or without hinges (4).

8 Claims, 1 Drawing Sheet

CLOSURE MEMBER FOR AN ELEVATOR SHAFT

FIELD OF THE INVENTION

The present invention relates to a closure member for an elevator shaft.

DESCRIPTION OF BACKGROUND ART

In a building being constructed, before the elevator doors are installed, there are generally open doorways fenced with various barriers to protect the workers against falling into the shaft. A plank laid across the doorway is a safety barrier serving this purpose. Removing and remounting such a plank is a laborious job and sometimes the remounting is neglected. Besides, a single safety plank like this provides no protection for the installers working in the shaft against objects falling down from the floors.

Other safety barriers used so far in the art are large plates or rectangular obstructions, attached with hooks or other fixing means to the wall surface facing the landing. However, large plates and meshworks are both difficult to handle and difficult to mount in place. Removing and remounting the obstructions is laborious e.g. when elevator components have to be passed into the elevator shaft through a doorway thus obstructed.

Another prior-art solution is a safety barrier having a wooden framework with transverse boards built on it to prevent people from falling down into the shaft. This safety barrier can be further provided with a plastic film to prevent small objects from falling down on installers in the shaft. This plastic film also provides some protection against the draught prevailing in the shaft space. A safety structure like this has to be built separately for each doorway and is also difficult to mount and to remove after use.

SUMMARY AND OBJECTS OF THE INVENTION

To provide a remedy for the drawbacks referred to above, the present invention discloses a safety apparatus which eliminates said drawbacks. The safety apparatus of the invention is mounted in the doorway of an elevator shaft for preventing individuals and other objects from falling down the shaft.

The advantages of the structure according to the invention include ease of installation and flexibility, allowing the safety apparatus to be used for different purposes at different times during the construction of the building. Listed below are some of the advantages:

- When hinges are used, the safety wall can be opened sideways.
- The location of a separate doorway in the safety wall can be determined according to the situation.
- The safety wall has a folding structure that renders it easy to collapse.
- The safety wall also provides protection against draught as it is high enough and the laminae have no openings except for the holes needed for the telescopic bars.
- The telescopic bars enable the safety wall to be used in doorways of different widths.
- Plastic laminae are light and relatively cheap, but other materials can be used as well, e.g. aluminium.
- The telescopic bar absorbs impacts as it is capable of bending somewhat according to the situation.
- The safety wall can also serve as a kind of demarcation line between contractors, because there is often some confusion as to which jobs belong to the elevator installers and which jobs belong to the building firm.
- The safety wall can also be mounted in front of the landing door to shield it from impacts, whereas the old safety barriers have to be removed before installation of the landing door.
- The structures supporting the safety wall can also be used for the installation of the landing door, i.e. the landing door can be mounted on the hinges of the safety wall.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
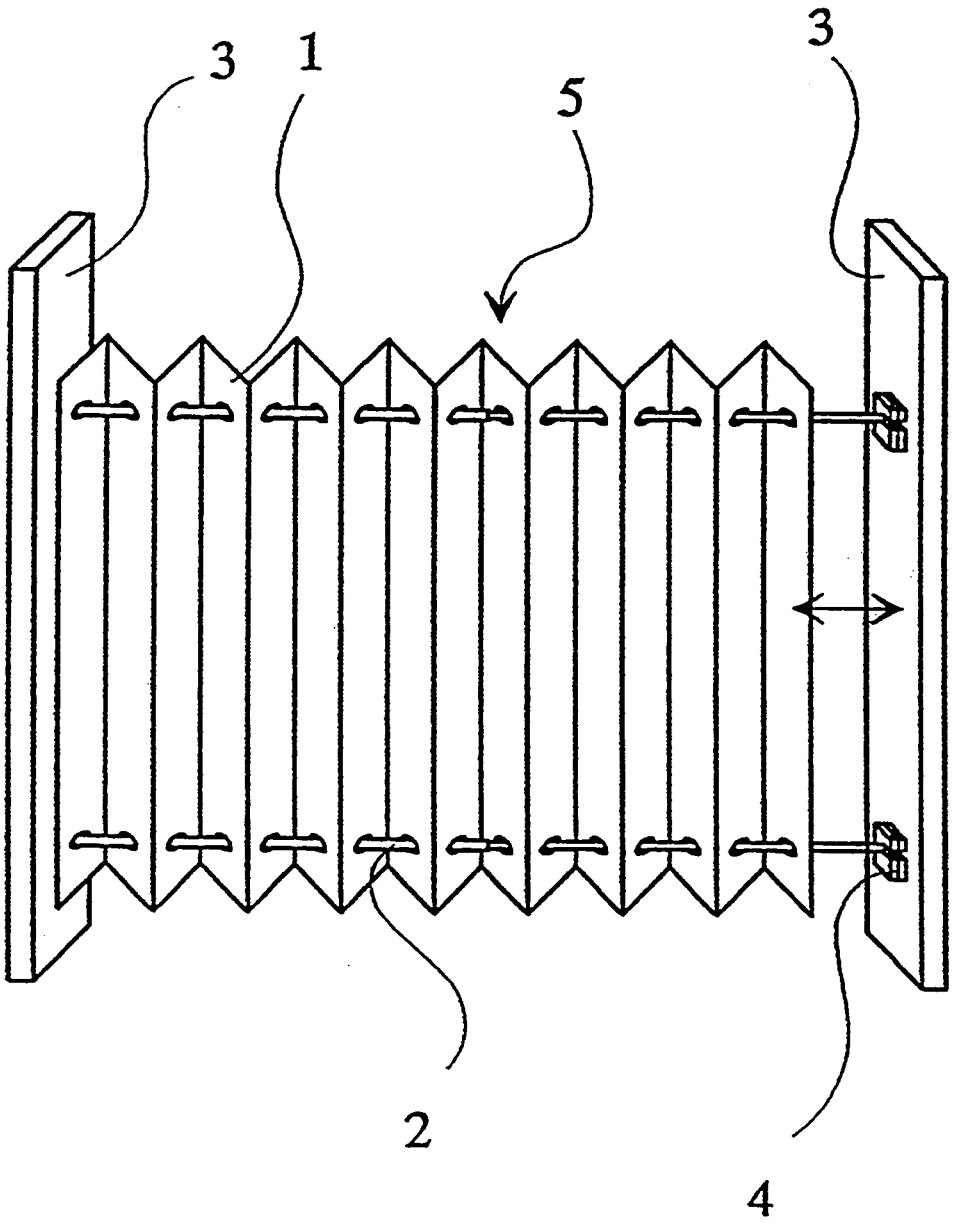
FIG. 1 is a front view of the safety wall of the invention for the doorway of an elevator shaft.

The safety apparatus of the invention consists of a protective element 5 which serves as a safety wall and resembles a folding door or a folding wall. The protective element is composed of successive laminae 1, which may be e.g. door laminae in serial production. The laminae are attached to each other in succession by their long edges so that the joint functions in the same way as a hinged joint or a joint coupling, enabling successive laminae to be folded over each other when the safety wall is to be packed into as small a space as possible or when it is opened to allow passage into the shaft. The length of the laminae is varied as needed. The ends of the laminae are provided with holes placed at the same height in each lamina. When the safety wall is to be mounted in place, telescopic bars serving as bearing elements 2 are inserted through the holes. The length of the bars can be varied by suitably pushing the telescopic bar sections into each other. The bearing elements reinforce the structure of the safety wall and, because of their telescopic design, permit the same safety apparatus to be used in doorways of different widths.

The safety wall is fixed to a doorway of the elevator shaft by means of the supporting structures 3 resembling the vertical parts of a door frame. The supporting structures 3 are mounted in the doorway like a door frame and, if necessary, they can be left in place after removal of the safety wall, in which case the landing door to be subsequently installed is mounted on these structures 3. The safety apparatus is attached to the supporting structures 3 by its telescopic bearing elements 2 by means of hinges 4. Thus, the safety wall can be easily opened by turning it aside, allowing large elevator components to be passed into the shaft. To facilitate the use of the safety wall, it is also possible to mount hinges 4 at both ends of the telescopic bars 2 serving as bearing elements.

The safety wall can also be provided with a door opening located in the middle of the wall or at some other suitable place, in which case the safety wall is opened at the middle by pushing the laminae aside and passage into the shaft takes place through the opening between the bars, the ends of the bars being attached to the supporting structures 3.

The safety apparatus can be interlocked with the supporting structure 3 by a known method so that unwarranted passage into the elevator shaft is not possible.

It is obvious to a person skilled in the art that different embodiments of the invention are not restricted to the example described above, but that they may instead be varied within the scope of the following claims. Instead of plastic laminae it is possible to use wooden or light metal laminae. The safety apparatus is attached to the walls of the shaft or the landing by means of known fixing elements. It is possible to use only one bearing element, in which case it has to be of a stronger construction than when two or more telescopic bars are used. Instead of bars it is also possible to use steel cables or a chain together with a spring. Furthermore, the safety wall can be mounted in a vertical position as required, in which case the telescopic bars nave to be sufficiently strong. In this case, easy passage into the elevator shaft is possible because the safety wall can be lifted up like a Venetian blind.

We claim:

1. A safety apparatus mounted in an opening of an elevator shaft for preventing individuals, animals or objects from falling down into the elevator shaft comprising:

a removable, foldable protective element extending substantially across the opening of the elevator shaft;

supporting structures removably secured to vertical walls forming the opening of the elevator shaft; and at least one bearing element extending substantially across the opening of the elevator shaft;

said at least one bearing element being removably secured to the supporting structures for supporting the protective element to extend across the opening of the elevator shaft use while permitting the protective element to be folded up during times of needed access to the elevator shaft.

2. The safety apparatus according to claim 1, wherein the protective element is composed of successive laminae provided with holes for each bearing element and that each bearing element is inserted into said holes.

3. The safety apparatus according to claim 1, wherein the at least one bearing element consist of two essentially horizontal telescopic bars attached to the supporting structure at least at one end by means of hinges.

4. The safety apparatus according to claim 1, wherein the supporting structure and hinges for mounting the at least one bearing element enable, if left in place, the formation of a door frame with hinges for a landing door to be later installed in the opening.

5. A safety apparatus mounted in an opening of an elevator shaft for preventing individuals, animals or objects from falling down into the elevator shaft comprising:

a removable, foldable protective element extending substantially across the opening of the elevator shaft;

supporting structures removably secured to vertical walls forming the opening of the elevator shaft; and at least one bearing element extending substantially across the opening of the elevator shaft;

said at least one bearing element being removably secured to the supporting structures for supporting the protective element to extend across the opening of the elevator shaft during normal use while permitting the protective element to be removed during times of needed access to the elevator shaft.

6. The safety apparatus according to claim 5, wherein the protective element is composed of successive laminae provided with holes for each bearing element and that each bearing element is inserted into said holes.

7. The safety apparatus according to claim 5, wherein the at least one bearing element consists of two essentially horizontal telescopic bars attached to the supporting structure at least at one end by means of hinges.

8. The safety apparatus according to claim 5, wherein the supporting structure and hinges for supporting the bearing element enable, if left in place, the formation of a door frame with hinges for a landing door to be later installed in the opening.

* * * * *